US008888094B2

(12) United States Patent
Hori

(10) Patent No.: US 8,888,094 B2
(45) Date of Patent: Nov. 18, 2014

(54) CONVEYING DEVICE

(71) Applicant: Riso Kagaku Corporation, Tokyo (JP)

(72) Inventor: Eiji Hori, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/185,105

(22) Filed: Feb. 20, 2014

(65) Prior Publication Data

US 2014/0239584 A1 Aug. 28, 2014

(30) Foreign Application Priority Data

Feb. 27, 2013 (JP) ..... 2013-036596

(51) Int. Cl.
*B65H 7/02* (2006.01)
*B65H 7/12* (2006.01)

(52) U.S. Cl.
CPC ... *B65H 7/12* (2013.01); *B65H 7/02* (2013.01)
USPC ..... 271/265.04; 271/270; 271/264

(58) Field of Classification Search
CPC ..... B65H 2301/51212; B65H 2301/5121; B65H 2557/50; B65H 2557/62; B65H 2557/65
USPC ..... 271/270, 264, 265.04, 265.01, 262
See application file for complete search history.

(56) References Cited

U.S. PATENT DOCUMENTS

| | | | | |
|---|---|---|---|---|
| 7,270,325 | B2 * | 9/2007 | Sano et al. | 271/262 |
| 7,347,419 | B2 * | 3/2008 | Sano et al. | 271/265.04 |
| 7,654,524 | B2 * | 2/2010 | Thomson | 271/262 |
| 7,950,656 | B2 * | 5/2011 | Adams | 271/262 |
| 8,500,119 | B2 * | 8/2013 | Hamada et al. | 271/242 |
| 2001/0042956 | A1 * | 11/2001 | Minoru et al. | 271/265.04 |

FOREIGN PATENT DOCUMENTS

| | | |
|---|---|---|
| JP | 9-208087 | 8/1997 |

* cited by examiner

*Primary Examiner* — Michael McCullough
*Assistant Examiner* — Howard Sanders
(74) *Attorney, Agent, or Firm* — Hamre, Schumann, Mueller & Larson, P.C.

(57) ABSTRACT

There is provided a conveying device including a controller that makes a conveying speed of a printing medium conveyed by a first conveyor unit be higher than a conveying speed of a printing medium conveyed by a second conveyor unit and makes the printing medium be conveyed while forming sagging on the printing medium between the first and second conveyor units. The controller makes a sheet sensor acquire the amount of light, which passes through the printing medium conveyed between a light emitting part and a light receiving part, as the amount of received light and determines whether or not the double-feed of the printing media has occurred only when this amount of received light is smaller than the double-feed criterion amount of received light at substantially the same conveying distance of the printing medium conveyed by the first conveyor unit.

3 Claims, 4 Drawing Sheets

CONVEYING DEVICE

BACKGROUND OF THE INVENTION

1. Field of the Invention

The present invention relates to a conveying device that conveys a printing medium.

2. Background Art

A technique, which detects the so-called double-feed of sheets in which a plurality of sheets are conveyed while overlapping each other by using an optical sensor, has been known in the related art (for example, see JP-A-9-208087). In this technique, a light emitting element and a light receiving element are disposed so as to face each other with a conveying path of a sheet interposed therebetween.

There is an inkjet printer that employs the above-mentioned technique for detecting the double-feed of sheets by the optical sensor. Specifically, there is known an inkjet printer in which an optical sensor that is disposed between a belt conveyor section that conveys a sheet sucked on a belt below an inkjet head and registration rollers that conveys the sheet to the belt conveyor section to detect the double-feed of sheets.

SUMMARY OF THE INVENTION

In the above-mentioned inkjet printer, the belt conveyor section conveys a sheet at a predetermined conveying speed immediately below the inkjet head. The conveying speed of a sheet conveyed by the registration rollers is higher than the conveying speed of a sheet conveyed by the belt conveyor section. The reason for this is to reliably make the sheet, which is to be conveyed, be sucked on the belt and to eliminate the influence of the registration rollers on the conveyance of the sheet when the sheet is conveyed by the belt. Due to a difference in speed, sagging is formed on the sheet between the registration rollers and the belt conveyor section. It is preferable that this sagging be formed at a predetermined position, in a predetermined direction, and at a predetermined level.

However, since various kinds of sheets are used in the printer or the condition of a sheet is changed due to external environments such as humidity, it is difficult to make the sagging of the sheet, which is formed between the registration rollers and the belt conveyor section, uniform. Here, if the level of sagging of the sheet or the direction of the sagging to be formed is changed, a positional relationship (a positional relationship in an up-and-down direction in FIG. 1) between the light emitting element and the light receiving element of the optical sensor and a sheet as an object to be detected is changed. For this reason, the amount of received light to be acquired may be significantly different from the amount of received light to be supposed. FIG. 4 shows that the amount of received light significantly varies due to the direction of sagging to be formed on a sheet when the light emitting elements emit light in the same direction.

The reason why the amount of light received by the light receiving element is changed due to the positional relationship between the light emitting element and the light receiving element and a sheet is that the amount of light reaching the light receiving element is reduced as a ratio of the scattered light to the light passing through the sheet is increased with the increase of an interval between the light receiving element and the sheet. Accordingly, a difference between a double-feed criterion value and the amount of light is increased depending on the direction and level of sagging to be formed, so that the false detection of the double-feed of sheets may be caused.

In a method of detecting the double-feed of sheets in the related art, the double-feed of sheets is determined only depending on whether or not a difference between a double-feed criterion value and the measured current amount of received light of a sheet is within a predetermined threshold range. That is, regardless of whether the acquired amount of received light is larger or smaller than a criterion value, the double-feed of sheets is determined only depending on whether or not the difference is in the range of a predetermined absolute value. However, a case in which the double-feed of sheets occurs is a case in which the acquired amount of received light is smaller the criterion value. The double-feed of sheets cannot occur in the reverse case. In the method in the related art, it is determined that the double-feed of sheets has occurred even in the reverse case. As a result, there is a problem in that the productivity of a device deteriorates.

The invention has been made in consideration of the above-mentioned circumstances, and an object of the invention is to provide a conveying device that can suppress the false detection of the double-feed of sheets.

According to a first aspect of the present invention, there is provided a conveying device including: a first conveyor unit that conveys a printing medium; a second conveyor unit that is disposed on a conveying path on the downstream side of the first conveyor unit and conveys the printing medium; a medium detecting unit that is disposed between the first and second conveyor units, includes a light emitting part emitting light to the conveying path and a light receiving part disposed so as to face the light emitting part with the conveying path interposed therebetween and receiving the light emitted from the light emitting part, and acquires the amount of light, which passes through the printing medium conveyed along the conveying path and is received by the light receiving part, as the amount of received light; a storage unit that stores a double-feed criterion amount of received light created on the basis of the amount of received light acquired by the medium detecting unit; and a controller that makes a conveying speed of the printing medium conveyed by the first conveyor unit be higher than a conveying speed of the printing medium conveyed by the second conveyor unit, and makes the printing medium be conveyed while forming sagging on the printing medium between the first and second conveyor units. The controller makes the medium detecting unit acquire the amount of received light according to a conveying distance of the printing medium conveyed along the conveying path, and determines that the double-feed of the printing media has occurred when this amount of received light is smaller than the double-feed criterion amount of received light at substantially the same conveying distance of the printing medium and a difference therebetween is equal to or larger than a predetermined threshold.

According to a second aspect of the invention, in the conveying device, the amount of received light and the double-feed criterion amount of received light may be obtained by the averaging of a plurality of amounts of received light acquired by the medium detecting unit for every predetermined conveying distance of the printing medium.

According to a third aspect of the invention, in the conveying device, the controller determines that the double-feed of the printing media has occurred when the amount of received light acquired by the medium detecting unit is smaller than the double-feed criterion amount of received light at substantially the same conveying distance of the printing medium and cases in which a difference therebetween is equal to or larger than a predetermined threshold successively occur a predetermined number of times.

According to the first aspect of the invention, the controller determines whether or not the double-feed of sheets has occurred only when the amount of light, which passes through a printing medium currently conveyed and reaches the light receiving part, is smaller than the double-feed criterion amount of received light at substantially the same conveying distance. Accordingly, it is possible to suppress the erroneous determination of the double-feed of sheets.

According to the second aspect of the invention, the amount of received light and the double-feed criterion amount of received light used for the determination of double-feed of sheets are obtained by the averaging of a plurality of amounts of received light acquired by the medium detecting unit. Accordingly, it is possible to reduce an error of the amount of received light in each measurement, so that it is possible to further suppress the erroneous determination of the double-feed of sheets.

According to the third aspect of the invention, the controller determines that the double-feed of the printing media has occurred when the acquired amount of received light is smaller than the double-feed criterion amount of received light at substantially the same conveying distance of the printing medium and cases in which a difference therebetween is equal to or larger than a predetermined threshold successively occur a predetermined number of times. Accordingly, it is possible to further suppress the erroneous determination of the double-feed of sheets.

DETAILED DESCRIPTION OF THE INVENTION

Figure 1:
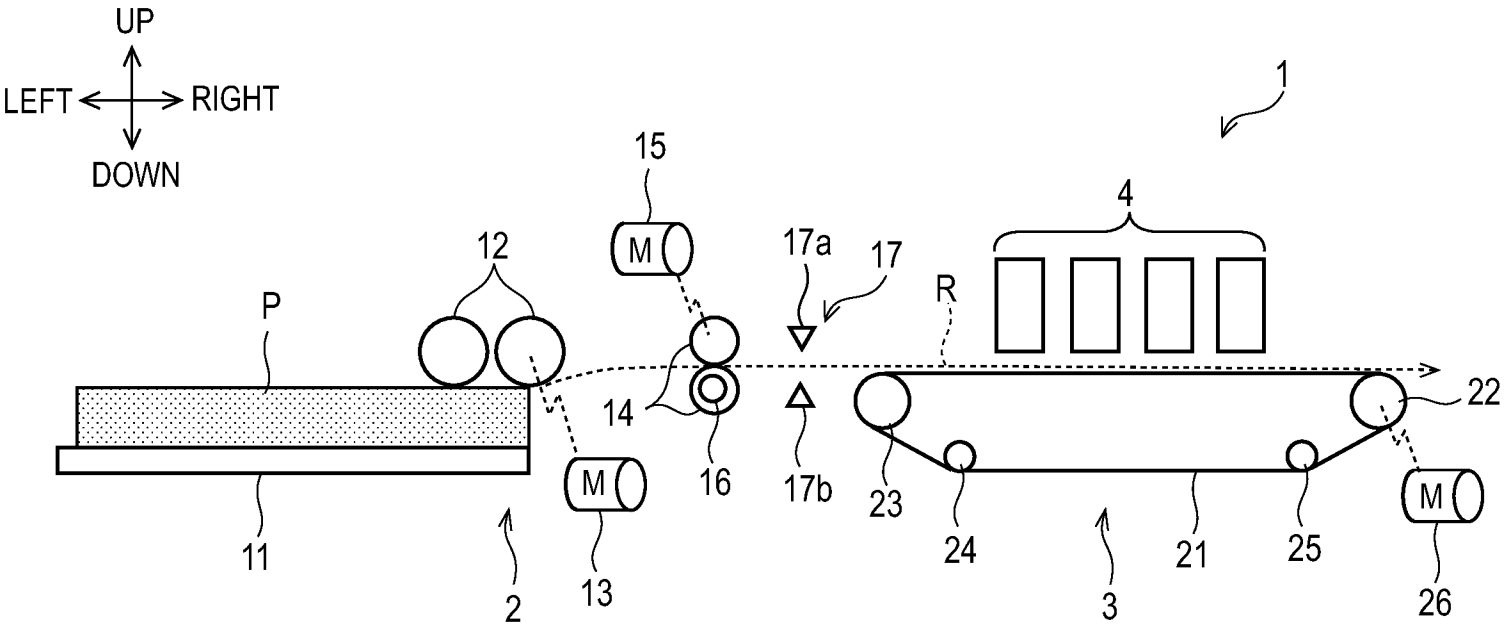
FIG. 1 is a schematic view showing the structure of a printer that includes a conveying device according to an embodiment.

An embodiment of the invention will be described below with reference to the drawings. In the respective drawings, the same or equivalent portions or components are denoted by the same or equivalent reference numerals. However, the drawings are schematic views and it should be noted that members shown in the drawings are different from actual members. Further, it goes without saying that portions having a relationship of different dimensions or different ratios are included in the drawings.

Furthermore, the embodiment to be described below exemplifies a device or the like that embodies the technical idea of the invention, and the disposition of the respective components and the like of the technical idea of the invention is not specified by the disposition to be described below. Various modifications may be added to claims in the technical idea of the invention.

Figure 2:
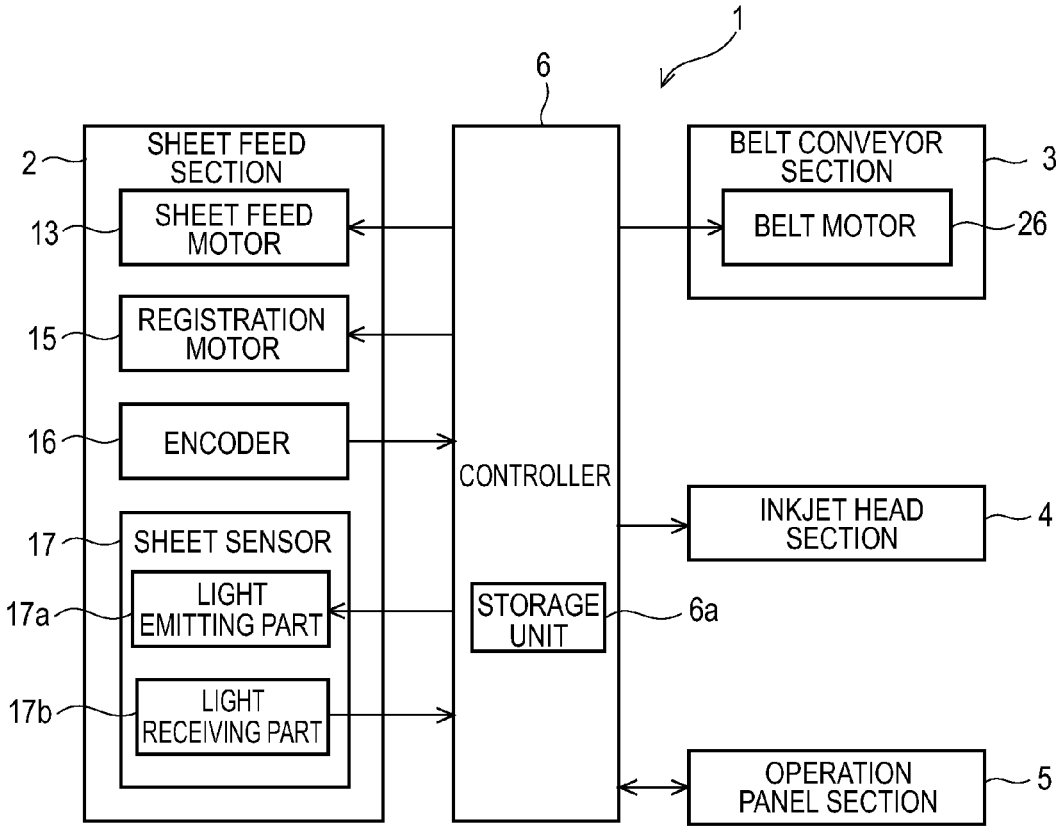
FIG. 2 is a block diagram showing the configuration of a control system of the printer shown in FIG. 1.

FIG. 1 is a schematic view showing the structure of a printer that includes a conveying device according to an embodiment of the invention, and FIG. 2 is a block diagram showing the configuration of a control system of the printer shown in FIG. 1. In the following description, the front side of the plane of FIG. 1 where a user is positioned is referred to as the front. Further, as shown in FIG. 1, the upper side, the lower side, the left side, and the right side, when seen by the user, are referred to as the upper side, the lower side, the left side, and the right side. Furthermore, a path shown in FIG. 1 by a broken line is a conveying path R along which a printing medium, that is, a sheet is conveyed, and a direction directed to the right from the left is a conveying direction. The upstream side and the downstream side in the following description mean the upstream side and the downstream side in the conveying path R of a sheet.

As shown in FIGS. 1 and 2, a printer 1 includes a sheet feed section 2, a belt conveyor section 3, an inkjet head section 4, an operation panel section 5, and a controller 6. Meanwhile, a conveying device includes the sheet feed section 2, the belt conveyor section 3, and the controller 6.

The sheet feed section 2 feeds a sheet P as a printing medium. The sheet feed section 2 includes a sheet feed tray 11, sheet feed rollers 12, a sheet feed motor 13, registration rollers 14, a registration motor 15, an encoder 16, and a sheet sensor 17.

Sheets P, which are used in the printing, are stacked on the sheet feed tray 11. The sheet feed tray 11 is provided with a sheet presence/absence detection sensor (not shown) that detects the presence of a sheet P on the sheet feed tray.

The sheet feed rollers 12 pick up the sheets P, which are stacked on the sheet feed tray 11, one by one and convey the sheets P to the registration rollers 14. The sheet feed rollers 12 are disposed above the sheet feed tray 11.

The sheet feed motor 13 drives the sheet feed rollers 12 at a predetermined timing.

The registration rollers 14 temporarily stop the sheet P conveyed by the sheet feed rollers 12, and then convey the sheet P to the belt conveyor section 3 while nipping (pinching) the sheet P. The registration rollers 14 are disposed on the downstream side of the sheet feed rollers 12. The registration rollers 14 correspond to a first conveyor unit in claims.

The registration motor 15 rotationally drives the registration rollers 14 at a predetermined timing.

The encoder 16 is installed on the registration roller 14, and outputs a pulse signal to the controller 6 at every predetermined rotation angle when the registration rollers 14 are rotated. That is, this pulse signal represents a conveying distance of the sheet P.

The sheet sensor 17 is disposed between the registration rollers 14 and the belt conveyor section 3 and is used to detect the double-feed of the sheets P to be conveyed. The sheet sensor 17 corresponds to a medium detecting unit in claims. The sheet sensor 17 includes a light emitting part 17*a* and a light receiving part 17*b*.

The light emitting part 17*a* is disposed above the conveying path R at a predetermined position between the registration roller 14 and the belt conveyor section 3. The light emitting part 17*a* emits light downward to the conveying path R. The light emitting part 17*a* is formed of a light emitting element such as an LED.

The light receiving part 17*b* receives light emitted from the light emitting part 17*a*, and outputs a signal that represents the amount of received light. The light receiving part 17*b* is disposed so as to face the light emitting part 17*a* with the conveying path R interposed therebetween. When a sheet P is present between the light emitting part 17*a* and the light receiving part 17*b*, the light receiving part 17*b* receives the amount of light passing through the sheet P. Meanwhile, the light emitting part 17*a* and the light receiving part 17*b* may be installed so as to have the positional relationship of FIG. 1 in an up-and-down direction in reverse.

The belt conveyor section 3 conveys the sheet P that is conveyed from the registration rollers 14. The belt conveyor section 3 is disposed on the downstream side of the registration rollers 14. The belt conveyor section 3 corresponds to a second conveyor unit in claims. The belt conveyor section 3 includes a conveying belt 21, a driving roller 22, driven rollers 23 to 25, and a belt motor 26.

The conveying belt 21 is an annular belt that is stretched over the driving roller 22 and the driven rollers 23 to 25. A plurality of belt holes, which are used to suck and hold the sheet P, are formed in the conveying belt 21. The conveying belt 21 sucks and holds the sheet P by a suction force that is generated in the belt hole by the driving of a fan (not shown). Since the conveying belt 21 is rotated in a clockwise rotation in FIG. 1 by the driving of the driving roller 22, the conveying belt 21 conveys the sheet P, which has been sucked and held, to the right.

The conveying belt 21 is stretched over the driving roller 22 and the driven rollers 23 to 25. The driving roller 22 rotates the conveying belt 21. The driven rollers 23 to 25 are driven by the driving roller 22 through the conveying belt 21.

The driven roller 23 is disposed at substantially the same height as the driving roller 22 so as to be spaced from the driving roller 22 by a predetermined interval in a left-and-right direction. The driven rollers 24 and 25 are disposed at substantially the same height below the driving roller 22 and the driven roller 23 so as to be spaced from each other by a predetermined interval in the left-and-right direction.

The belt motor 26 rotationally drives the driving roller 22. The rotational speed of the driving roller 22 is a speed at which the desired productivity of the printer 1 can be maintained, and is the speed lower than the rotational speed of the registration roller 14.

The inkjet head section 4 includes a plurality of line type inkjet heads in which a plurality of nozzles are arranged in a direction (a front-and-rear direction) substantially orthogonal to the conveying direction of the sheet P. The inkjet head section 4 is disposed above the belt conveyor section 3. The inkjet head section 4 prints an image by ejecting ink onto the sheet P, which is conveyed by the belt conveyor section 3, from the inkjet heads.

The operation panel section 5 receives an input operation of a user and displays various kinds of information and the like. The operation panel section 5 includes an input unit (not shown) that includes operation buttons, a touch panel, and the like used to perform various input operations by a user; and a display unit (not shown) that is formed of a liquid crystal display panel or the like displaying various kinds of information.

The controller 6 controls the operation of each section of the printer 1. The controller 6 includes a CPU, a RAM, a ROM, and a storage unit 6*a* (a non-volatile memory such as a hard disk). Specifically, the controller 6 performs control to convey the sheet P to the belt conveyor section 3 by the sheet feed section 2 and to perform printing on the sheet P by ejecting ink by the inkjet head section 4 while conveying the sheet P by the belt conveyor section 3.

In the operation of the sheet feed section 2, when the controller 6 drives the sheet feed rollers 12 and the sheet P conveyed by the sheet feed rollers 12 bumps against the registration rollers 14, the controller 6 stops the sheet feed rollers 12 after rotating the rollers by a predetermined level of sagging. After that, the controller 6 starts the driving of the registration rollers 14 at a predetermined timing that is set for each sheet size. When the front end of the sheet P sent by the registration rollers 14 reaches the belt conveyor section 3, the sheet P is conveyed by the belt conveyor section 3 and the registration rollers 14. The controller 6 controls each motor so that the conveying speed of the sheet conveyed by the registration rollers 14 is higher than the conveying speed of the sheet conveyed by the belt conveyor section 3, and makes the sheet P continue to be conveyed while there is no conveying load that is caused by the conveyance of the sheet performed by the registration rollers 14 and is applied to the sheet P, when the sheet is conveyed by the belt conveyor section 3. Due to a difference in speed, the sheet P is conveyed while sagging is formed on the sheet P between the registration rollers 14 and the belt conveyor section 3.

Further, the controller 6 performs the processing for acquiring a double-feed criterion amount of received light that is used to determine the double-feed of the sheets P on the basis of the amount of light received by the light receiving part 17*b*, and the processing for detecting the double-feed using the double-feed criterion amount of received light. In the processing for detecting the double-feed, the controller 6 acquires the amount of received light according to a conveying distance of the sheet P that is conveyed to the downstream side, and detects the double-feed on the basis of the result of the comparison between the acquired amount of received light and the double-feed criterion amount of received light.

Next, the operation of the printer 1 will be described.

First, the print operation of the printer 1 will be described.

When receiving a print start signal, the controller 6 rotationally drives the driving roller 22 by the belt motor 26. Accordingly, the conveying belt 21 is driven to revolve. The controller 6 drives the belt conveyor section 3 so that the belt conveyor section 3 conveys the sheet P at a desired printing conveying speed (Vg).

Further, the controller 6 rotationally drives the sheet feed rollers 12 by the sheet feed motor 13. The sheet feed rollers 12 take out a sheet P from the sheet feed tray 11, and send the sheet P to the registration rollers 14. When the sheet P bumps against the registration rollers 14, the controller 6 stops the sheet feed rollers 12 after continuing to convey the sheet to form a predetermined level of sagging on the sheet P. After that, the controller 6 rotationally drives the registration rollers 14 at a predetermined sheet feed timing by the registration motor 15.

When the front end of the sheet P sent by the registration rollers 14 reaches the belt conveyor section 3, the sheet P extends over the belt conveyor section 3 and the registration rollers 14. Furthermore, until the rear end of the sheet P passes through the registration rollers 14, the sheet P is conveyed by the belt conveyor section 3 and the registration rollers 14. Here, the controller 6 makes the conveying speed Vr of the sheet, which is conveyed by the registration rollers 14, be higher than the printing conveying speed Vg of the sheet conveyed by the belt conveyor section 3 (Vr>Vg).

Figure 3:
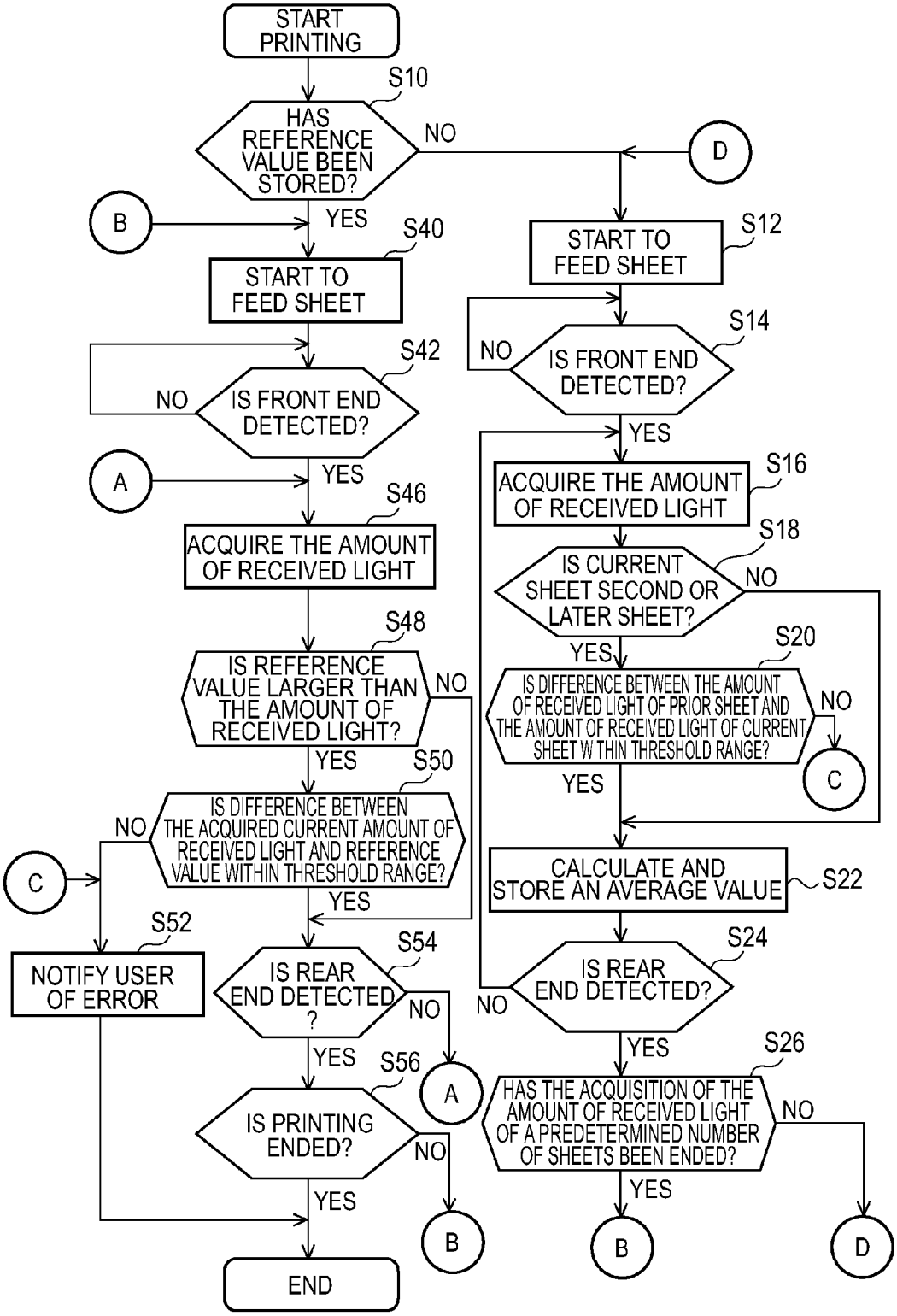
FIG. 3 is a flowchart illustrating the processing for acquiring a double-feed criterion amount of received light (reference value) and the processing for detecting double-feed.

Accordingly, as shown in FIG. 3, the sheet P is conveyed toward the inkjet head section 4 while sagging is formed on the sheet P between the registration rollers 14 and the belt conveyor section 3. The controller 6 makes ink be ejected onto the sheet P, which is conveyed below the inkjet head section 4, from each nozzle of each inkjet head of the inkjet head section 4 on the basis of print data. Since sagging is formed on the sheet P as shown in FIG. 3, the change of the printing conveying speed Vg of the sheet conveyed by the belt conveyor section 3, which is caused by excessive tension applied to the sheet P, is prevented. As a result, the deterioration of the quality of a printed image is suppressed.

The controller 6 makes sheets be sequentially fed by driving the sheet feed rollers 12 and the registration rollers 14 according to the appointed number of sheets to be printed. Further, the controller 6 makes the respective sheets P, which are fed and conveyed on the conveying belt 21, be sequentially printed by the inkjet head section 4.

In the above-mentioned print operation, the controller 6 performs the processing for acquiring a double-feed criterion amount of received light and the processing for detecting the double-feed using the double-feed criterion amount of received light. The processing will be described with reference to a flowchart of FIG. 3.

Acquisition of Double-feed Criterion Amount of Received Light (Reference Value)

When receiving a print instruction from a user and starting a print operation, the controller 6 determines whether or not a double-feed criterion amount of received light (simply referred to as a "reference value" in FIG. 3. Further, also simply referred to as a "reference value" in the following description) has been stored in the storage unit 6*a* in Step S10 of FIG. 3.

If the reference value is not stored (No in S10), the controller 6 starts the revolution of the conveying belt 21, maintains a predetermined speed, starts the conveyance of the sheet P performed by the sheet feed rollers 12 and the registration rollers 14, and makes the light emitting part 17*a* of the sheet sensor 17 start to emit a constant amount of light.

If the front end of the sheet P is detected by the sheet sensor 17, that is, if light is blocked due to the presence of the sheet P and the amount of light received by the light receiving part 17*b* is significantly reduced (Yes in S14), the controller 6 starts the acquisition of the amount of light that is received by the light receiving part 17*b* (S16). Subsequently, the controller 6 performs the acquisition of the amount of light, which is received by the light receiving part 17*b*, at a predetermined interval. This predetermined interval is the time when the number of pulses obtained from the encoder 16 reaches a predetermined number.

Figure 4:
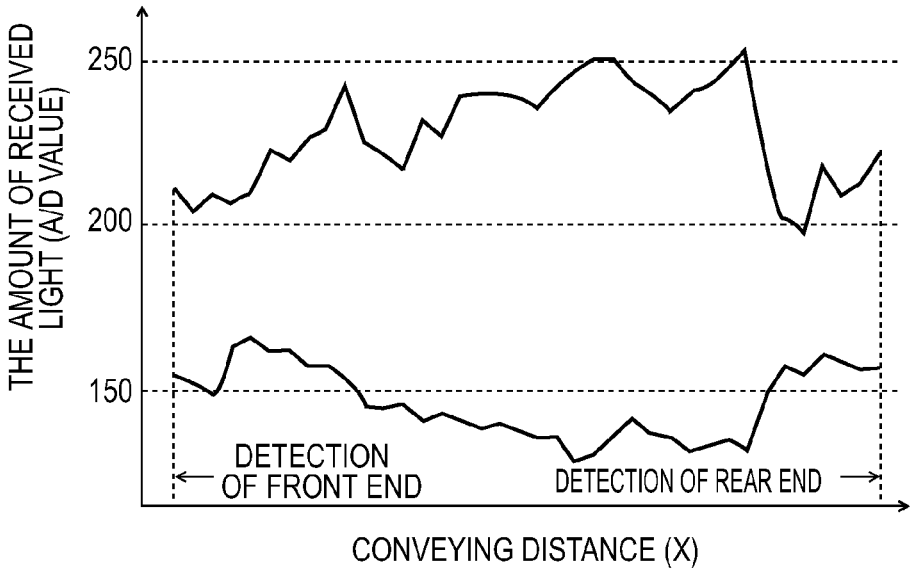
FIG. 4 is a view showing a measured value of the amount of received light depending on a difference of sagging, which is formed on a printing medium, in a direction.

After that, in Step S18, the controller 6 determines whether or not the sheet P as the current object to be detected is the second or later sheet. If determining that the current sheet P to be detected is not the second or later sheet, that is, is the first sheet (No in S18), the controller 6 stores a value of the acquired amount of received light in the storage unit 6*a* in association with the conveying distance of the sheet P that is obtained from the encoder 16 (S22) and repeats the acquisition of the amount of light, which is received by the light receiving part 17*b*, until the rear end of the sheet P is detected in Step S24 (S16, S18, and S22). The data of the amount of received light of one sheet P based on the conveying distance of the sheet P shown in FIG. 4 is stored in the storage unit 6*a* through this processing. Here, the conveying distance of the sheet P corresponds to the conveying amount of the sheet P that is conveyed by the registration rollers 14 after the front end of the sheet P is detected by the sheet sensor 17.

Meanwhile, if determining that the current sheet P to be detected is the second or later sheet in Step S18, the controller 6 calculates a difference between the amount of received light, which is acquired at the current conveying distance, and the amount of received light that is stored in the storage unit 6*a* and is obtained when a sheet prior to this sheet is used as an object (S20).

If this difference is within a predetermined threshold range, specifically, a difference between the amount of received light, which is obtained when a prior sheet is used as an object, and the amount of received light, which is acquired when the current sheet P is used as an object, is out of the range of ±25% (No in S20), the controller 6 determines that the double-feed of any one of the sheets P used as the current object to be measured and the sheets P used as the prior object to be measured has occurred, and ends the processing after making the operation panel section 5 display an error. Specifically, the controller 6 makes the display unit of the operation panel section 5 display a message that notifies a user of the occurrence of the double-feed of the sheets P, and stops the conveyance of the sheet P by stopping the sheet feed section 2 and the belt conveyor section 3. Meanwhile, the threshold range in Step S20 needs to be set as a range of ± as described above. The reason for this is to prevent the acquisition of a false reference value since it is not possible to assure that the double-feed of the sheets P does not occur when the reference value is acquired.

Meanwhile, if it is determined that the difference in the amount of received light, which is calculated in Step S20, is within a predetermined threshold range (Yes in S20), the controller 6 determines that the acquired amount of received light does not have a problem, calculates an average value of the amount of received light that is acquired at the current conveying distance obtained from the encoder 16 and the amount of received light that is stored in the storage unit 6*a*, and stores (saves) this average value in the storage unit 6*a* in association with the conveying distance of the sheet P. Further, the controller 6 repeats the processing of Steps S16 to S22 until the rear end of the sheet P is detected in Step S24 by the sheet sensor 17 (S16, S18, and S22).

If the rear end of the sheet is detected (Yes in S20), the controller 6 determines whether or not the amount of received light of a predetermined number of sheets P has been acquired (S22). Here, the predetermined number of sheets only has to be the number of sheets that is enough to create the reference value used for the determination of double-feed of the sheets. The predetermined number of sheets may be arbitrarily set through the operation panel section 5 by a user, and may be stored in the storage unit 6*a* as a default at the time of the shipment of the device.

If determining that the acquisition of the amount of received light of a predetermined number of sheets has not been ended (No in S26), the controller 6 returns to Step S12 and repeats the processing of Steps S12 to S26.

If determining in Step S26 that the acquisition of the amount of received light of a predetermined number of sheets has been ended, the controller 6 shifts the processing to Step 40. The average value of the amount of received light at the conveying distance of the sheet P, which is stored in the storage unit 6*a* at this time, becomes a double-feed criterion amount of received light (reference value).

Meanwhile, if the double-feed criterion amount of received light (reference value) has been acquired, the print processing may be performed or not performed by the inkjet head section 4.

Processing for Detecting Double-Feed

If the double-feed criterion amount of received light (reference value) is present in the storage unit 6*a* (Yes in S10 or Yes in S26), the controller 6 starts a sheet feed operation that is performed by the sheet feed rollers 12 and the registration rollers 14 (S40).

If the front end of the sheet P is detected by the sheet sensor 17 (Yes in S42), the controller 6 starts the acquisition of the amount of light that is received by the light receiving part 17*b*.

Further, the controller 6 compares the amount of received light, which is acquired by the light receiving part 17*b* at the conveying distance (for example, X) of the sheet P obtained from the encoder 16, with the reference value at this conveying distance (for example, X) that is stored in the storage unit 6*a* (S48). If the current amount of received light is larger than the reference value (No in S48), the controller 6 determines that the double-feed of the sheets does not occur and shifts the processing to Step 54.

Meanwhile, if the acquired current amount of received light is smaller than the reference value (Yes in S48), there is a concern that the double-feed of the sheets P as an object to be detected occurs. Accordingly, the controller 6 further determines whether or not a difference between these values is within a predetermined threshold (for example, within −25%) (S50). Specifically, the controller 6 determines whether or not an expression of "100×(acquired current amount of received light-reference value)/reference value≤threshold (−25%)" is satisfied. Meanwhile, the controller has determined whether or not a difference between these values is within the predetermined threshold, but may determine whether or not the difference between these values is smaller than the predetermined threshold. Further, it is preferable that this threshold be appropriately changed according to the type of the sheet P, for example, a cardboard, plain paper, and thin paper.

If the difference between these values exceeds the predetermined threshold range (No in S50), the controller 6 determines that the double-feed of the sheets has occurred, makes the operation panel section 5 display an error (S52), and ends the processing. Specifically, the controller 6 stops the conveyance of the sheet P by stopping the sheet feed section 2 and the belt conveyor section 3, and stops the printing that is performed by the inkjet head section 4.

Meanwhile, if the difference between these values is within the predetermined threshold range (Yes in S50), the controller 6 repeats the processing of Steps S46 to S54 until the rear end of the sheet P is detected (Yes in S54).

Further, the controller 6 repeats the processing of Steps S40 to S56 until the print processing of a predetermined number of sheets is ended (Yes in S56), and ends the processing if determining that the printing of the predetermined number of sheets has been ended (Yes in S56).

As described above, in the printer 1, the controller 6 compares the acquired current amount of received light with the stored double-feed criterion amount of received light (reference value) and further determines a double-feed error only when the acquired current amount of received light is smaller than the double-feed criterion amount of received light (reference value). Accordingly, since a double-feed error is not notified if the acquired amount of received light is larger than the double-feed criterion amount of received light (reference value), it is possible to suppress the erroneous determination of the double-feed of the sheets. Further, even when a value of the acquired amount of received light is changed to be larger than the double-feed criterion amount of received light (reference value) due to the generation of noises, it is possible to suppress the erroneous determination of the double-feed of the sheets. Further, if the acquired amount of received light is smaller than the double-feed criterion amount of received light (reference value), the controller 6 further determines whether the double-feed of the sheets has occurred by further determining whether or not a difference between the acquired current amount of received light and the reference value exceeds a predetermined threshold. Accordingly, it is possible to suppress the erroneous determination of the double-feed of the sheets in a device that makes a sheet P have sagging and delivers the sheet between the respective members even though the amount of received light fluctuates due to the change of the level or direction of sagging.

Modification

In the above description, the determination of double-feed of the sheets performed by the controller 6 has been performed whenever the light receiving part 17*b* acquires the amount of received light. However, the light receiving part 17*b* acquires the amount of received light predetermined times, and it may be determined whether or not the double-feed of the sheets has occurred using the block average amount of received light that is obtained by the averaging of these values. That is, the determination of the double-feed of the sheets is performed for every predetermined area in the conveying direction of the sheet P. It is possible to reduce a measurement error by using a sheet average value in this way. In this case, a block average value, which is obtained by the averaging of values at predetermined times, is also used as the double-feed criterion amount of received light.

Further, in the determination of double-feed of the sheets performed by the controller 6, it has been determined that the double-feed of the sheets has occurred when the amount of received light is smaller than the double-feed criterion amount of received light and a difference between these is larger than a threshold. That is, when this state occurs one time, it has been determined that the double-feed of the sheets has occurred. However, when the states successively occur a predetermined number of times, it may be determined that the double-feed of the sheets has occurred. Accordingly, even when the amount of light received by the light receiving part 17*b* is significantly changed only one time due to some circumstances (for example, the generation of noises), it is not erroneously determined that the double-feed of the sheets has occurred. Therefore, it is possible to maintain the productivity of the device. Meanwhile, even in this case, the double-feed of the sheets may be determined using block average values of the amount of received light.

Furthermore, the embodiment in which the sheet feed section 2 of the printer 1 includes one sheet feed tray 11 has been described above. However, it is common that an actual printer 1 is provided with a plurality of sheet feed trays and different types of sheets P having different sizes are loaded in the respective sheet feed trays.

Accordingly, when an average value, which becomes a double-feed criterion amount of received light later, is stored in the storage unit 6*a* in Step S22 of FIG. 3 if the printer 1 is provided with a plurality of sheet feed trays, it is preferable that the average value be stored in association with the sheet feed tray of a sheet feed source of the sheet P. Further, a sheet feed source may be specified at the time of printing, and the double-feed of the sheets may be determined using a double-feed criterion amount of received light that corresponds to this sheet feed source.

Furthermore, regardless of whether the printer 1 is provided with a single sheet feed tray or a plurality of sheet feed trays, the controller 6 may be adapted to perform the processing for acquiring the double-feed criterion amount of received light, which is shown in FIG. 3, again in at least one case of a case in which there is no sheet P on the sheet feed tray, a case in which the change of the type (size, thickness, a special use, or the like) of the sheet P on the sheet feed tray is detected, and a case in which the sheet feed tray is drawn out of the body of the printer 1. Special sensors may be provided to detect these changes.

What is claimed is:

1. A conveying device comprising:

a first conveyor unit that conveys a printing medium;

a second conveyor unit that is disposed on a conveying path on a downstream side of the first conveyor unit and conveys the printing medium;

a medium detecting unit that is disposed between the first and second conveyor units, including a light emitting part emitting light to the conveying path and a light receiving part disposed so as to face the light emitting part with the conveying path interposed therebetween and receives the light emitted from the light emitting part, and acquires an amount of light, which passes through the printing medium conveyed along the conveying path and is received by the light receiving part, as an amount of received light;

a storage unit that stores a double-feed criterion amount of received light created on a basis of the amount of received light acquired by the medium detecting unit; and a controller that makes a conveying speed of the printing medium conveyed by the first conveyor unit higher than a conveying speed of the printing medium conveyed by the second conveyor unit, and makes the printing medium to be conveyed while forming a sag on the printing medium between the first and second conveyor units, wherein the controller makes the medium detecting unit acquire the amount of received light according to a conveying distance of the printing medium conveyed along the conveying path, and determines that the double-feed of the printing media has occurred when the amount of received light is smaller than the double-feed criterion amount of received light at substantially the same conveying distance of the printing medium and a difference therebetween is equal to or larger than a predetermined threshold.

2. The conveying device according to claim 1, wherein the amount of received light and the double-feed criterion amount of received light are obtained by the averaging of a plurality of amounts of received light acquired by the medium detecting unit for each of predetermined conveying distance of the printing medium.

3. The conveying device according to claim 1, wherein the controller determines that the double-feed of the printing media has occurred when the amount of received light acquired by the medium detecting unit is smaller than the double-feed criterion amount of received light at substantially the same conveying distance of the printing medium and cases in which a difference therebetween is equal to or larger than a predetermined threshold successively occur a predetermined number of times.

* * * * *